US005754917A

United States Patent [19]

Fromm et al.

[11] Patent Number: 5,754,917

[45] Date of Patent: May 19, 1998

[54] HIGH TEMPERATURE SAFETY SYSTEM FOR A FUSING SUBSYSTEM MODULE FOR AN ELECTROPHOTOGRAPHIC PRINTER

[75] Inventors: Paul M. Fromm, Rochester; Edward C. Hanzlik, Fairport; James F. Smoak, Rochester; Ihor Kulbida, Fairport, all of N.Y.

[73] Assignee: Xerox Corporation, Stamford, Conn.

[21] Appl. No.: 834,005

[22] Filed: Apr. 11, 1997

[51] Int. Cl.[6] ..... G03G 15/20

[52] U.S. Cl. ..... 399/33; 219/216; 219/494; 399/69

[58] Field of Search ..... 399/33, 69, 328, 399/334, 122; 219/216, 494, 481, 497; 374/163

[56] References Cited

U.S. PATENT DOCUMENTS

| | | | |
|---|---|---|---|
| 4,541,708 | 9/1985 | Shigenobu | 399/33 |
| 4,585,325 | 4/1986 | Euler | 399/69 |
| 4,994,852 | 2/1991 | Matsuuchi et al. | 399/33 |
| 5,350,896 | 9/1994 | Amico et al. | 219/216 |
| 5,373,141 | 12/1994 | Ko | 219/497 |
| 5,497,218 | 3/1996 | Amico | 399/69 |
| 5,579,098 | 11/1996 | Noguchi et al. | 399/122 |

*Primary Examiner*—Arthur T. Grimley
*Assistant Examiner*—Sophia S. Chen
*Attorney, Agent, or Firm*—R. Hutter

[57] ABSTRACT

A customer-replaceable module having a fusing subsystem therein for a electrophotographic printer or copier includes three separate devices for detecting potentially dangerous temperature conditions within the module. A first thermal cutoff spaced from the fuser roll can detect high temperatures caused by incorrect software operation and hardware failures. A second thermal cutoff contacting the fuser roll outside of the paper path can detect failures associated with software malfunctions and paper shielding the first thermal cutoff. A thermistor contacting the fuser roll in the paper path can interface with the control software of the printer or copier itself. The thermal cutoffs function entirely independently of the control software of the printer or copier. The module may further include an electronically-readable memory for recording failure conditions.

9 Claims, 2 Drawing Sheets

HIGH TEMPERATURE SAFETY SYSTEM FOR A FUSING SUBSYSTEM MODULE FOR AN ELECTROPHOTOGRAPHIC PRINTER

FIELD OF THE INVENTION

The present invention relates to a safety system for detecting high temperatures in the fusing subsystem of an electrophotographic printer or copier.

BACKGROUND OF THE INVENTION

Fusing is an essential step in the well-known process of electrostatographic printing or copying. In the fusing step, powdered toner which has been transferred in imagewise fashion onto a medium, such as a sheet of paper, is fixed, typically by a combination of heat and pressure, to form a permanent image on the medium. The basic architecture of a fuser is well known: a pressure roll rolls against a fuser roll, the image-bearing sheet passing through a nip between the rolls. The side of the medium having the image to be fixed faces the fuser roll, which includes a heat source, such as a resistance heater, at the core thereof. The combination of heat from the fuser roll and pressure between the fuser roll and pressure roll fixes the toner to form the permanent image.

The fusing subsystem is in many ways the most potentially dangerous portion of an electrophotographic printer or copier. The fuser roll is typically maintained at a surface temperature of as high as 400 degrees F., and sheets of paper are constantly brought into contact therewith. A paper jam near the nip of the fuser could easily cause a sheet of paper to dwell for an extended period against the hot surface of the fuser roll, which can result in smoke or odor from charred paper. Therefore, numerous safety systems are preferably incorporated around the fuser subsystem.

DESCRIPTION OF THE PRIOR ART

US-A-5,350,896 discloses a fuser subsystem in which a fuser roller includes two separate heating lamps therein. Two thermistors are positioned with one adjacent the inboard end of the fuser and the other adjacent the outboard end of the fuser. The outboard thermistor is used to determine the desired on time of the fuser lamp and the inboard thermistor is used to determine which of the two lamps is on.

US-A-5,373,141 discloses a temperature control circuit for a fusing subsystem in which a thermistor outputting a temperature-dependent voltage is compared to a reference voltage to cut off power to the fuser.

US-A-5,497,218 discloses a system for calibrating thermistors in a digital printer. Three thermistor resistance measurements are taken at various temperatures, and the output resistance values are converted to digital bits which a microprocessor can relate to temperature. The three values are used for constructing a calibration curve, which facilitates interpolation between calibration points. This calibration step allows the thermistor to become a common part for a family of products which may require different standby and run time temperatures.

SUMMARY OF THE INVENTION

According to one aspect of the present invention, there is provided a fuser apparatus for an electrophotographic printer, comprising a roll, a portion of the length of the roll defining a width of a paper path, a heat source, and a conductor for conducting electricity to the heat source. A first thermal cutoff detects a temperature above a first predetermined threshold within the width of the paper path, and second thermal cutoff detects a temperature above a second predetermined threshold not within the width of the paper path.

According to another aspect of the present invention, there is provided a fuser apparatus for an electrophotographic printer, comprising a roll, a length of the roll defining a width of a paper path, a heat source, and conductor for conducting electricity to the heat source. A first thermal cutoff is disposed in series on the conductor, and breaks the conductor in response to detecting a temperature above a first predetermined threshold. A second thermal cutoff, not directly connected to the conductor, detects a temperature above a second predetermined threshold.

According to another aspect of the present invention, there is provided a fuser apparatus for an electrophotographic printer, comprising a roll, a portion of the length of the roll defining a width of a paper path, a heat source, and conductor for conducting electricity to the heat source. A first thermal cutoff is disposed in series on the conductor for breaking the conductor in response to detecting a temperature above a first predetermined threshold. A relay supplies electricity to the conductor. A second thermal cutoff is associated with the relay and closes the relay to stop supplying electricity to the conductor in response to detecting a temperature above a second predetermined threshold.

DETAILED DESCRIPTION OF THE INVENTION

Figure 1:
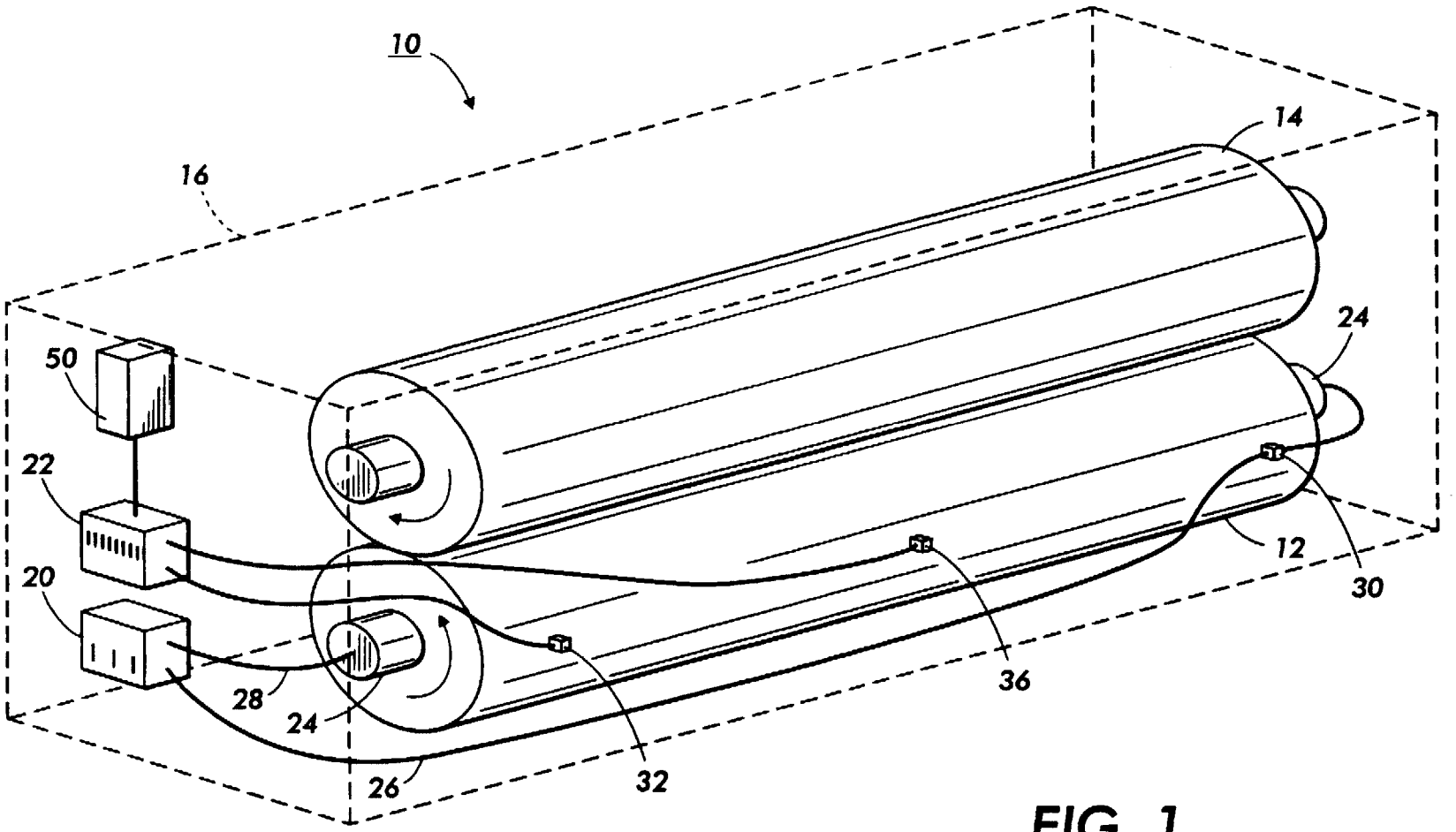
FIG. 1 is a simplified perspective view of a fusing subsystem for a printer or copier, in the form of a separable module, showing the essential elements of the present invention.

FIG. 1 is a perspective view of a module, also known as a "customer replaceable unit" or CRU, which includes a fusing subsystem. Such a module, here generally indicated as 10, is preferably adapted to be easily installed in an electrophotographic printer or copier. In a preferred embodiment of the invention, the module 10 includes a fuser roll 12, which rolls against a pressure roll 14, in a manner familiar in the art. The rolls 12, 14 can be mounted within a self-contained housing, here indicated in phantom as 16. Preferably, the housing 16 is designed so that a user can install the entire module 10 in a printer or copier merely by handling only the outside of housing 16 without having to access any internal structure of the module 10. There will typically also be provided within housing 16 other structures which are typically related to the function of rolls 12, 14, such as stripper fingers, a cleaning web, etc., which are not immediately germane to the present invention.

To obtain the desired "modularity" of module 10, there is disposed at one end thereof a number of sockets or equivalent structures, which mate with complementary structures within the machine in which the module 10 is installed. In the illustrated embodiment, there is provided an AC socket 20 and a DC socket 22. The specific designs of these sockets 20, 22 and their complementary parts within the machine (not shown) can comprise any stock plug and socket configurations consistent with the power and information-transfer requirements which will be discussed below.

AC socket 20 accesses a relatively high-voltage power supply within the machine and in large part transfers this high voltage (115 VAC in US markets) to a heating lamp disposed in the core of fuser roll 12, one end of which is shown as 24. As shown, a conductor 26 extends from the socket 20 to the opposite side of fuser roll 12 to access the heat lamp therein, and another conductor 28 completes the circuit between heat lamp 24 and socket 20. Thus, conductors 26 and 28 connect the heat lamp 24 to the supply of AC through socket 20. In a preferred embodiment of the invention, conductor 26 can be in the form of a simple strip of conductive material, such as copper, which is essentially embedded against or within an interior surface of housing 16, to simplify a manufacturing procedure.

DC socket 22 is intended to pass through relatively low voltage levels, such as 24 volts DC or less, through any of a plurality of prongs and/or sockets. Thus the DC socket 22 can act as a contact point both for a thermal cutoff and a thermistor, as will be described in detail below, and can also pass through logic signals, typically in the 5 volt range, to enable communication with a electronic memory in the module 10, as will be described below.

As can be seen in the Figure, there is disposed along conductor 26 a circuit breaker, referred to as a "AC thermal cutoff" 30. Thermal cutoff 30 is a circuit breaker, or in effect a fuse, which will cause an interruption in the alternating current flow along conductor 26 when the temperature thereof exceeds a predetermined amount. In a preferred embodiment of the invention, the thermal cutoff 30 is spaced closely (at least 1 mm, and more preferably about 2 mm) from the surface of fuser roll 12, and is also preferably placed along a portion of fuser roll 12 which corresponds to the width of a paper path of sheets passing through the nip between fuser roll 12 and pressure roll 14.

The DC thermal cutoff 32 is preferably disposed in direct contact with the surface of fuser roll 12, but in a position which is out of the width of a paper path over fuser roll 12. This position of DC thermal cutoff 32 outside the paper path ensures that it will not be shielded by paper and thus can directly detect the temperature of the fuser roll. DC thermal cutoff 32 is preferably a circuit breaker or fuse which opens a circuit as a result of a temperature above a predetermined threshold. Further, DC thermal cutoff 32 is not directly connected to the conductor 26, but rather is connected to DC socket 22 and thus to a relay external to module 10, as will be explained in detail below.

In a preferred embodiment of the present invention, there is further provided what is here referred to as a "software" thermistor 36. The software thermistor 36 effectively contacts the surface of fuser roll 12 in a portion thereof corresponding to the width of the paper path. The output signal of thermistor 36, which typically reflects the instantaneous temperature of fuser roll 12, is simply relayed back to DC socket 22. DC socket 22, which may contain any number of prongs and/or sockets to connect to an external control system, simply relays the direct signal from thermistor 36 to a software-based control system within the printer or copier itself, as will be described below. Software thermistor 36 differs somewhat from the other two thermal cutoffs 30, 32, in that it does not directly operate as a circuit breaker, but rather simply reports the current temperature of the fuser roll surface to a software-based control system within the printer or copier.

Figure 2:
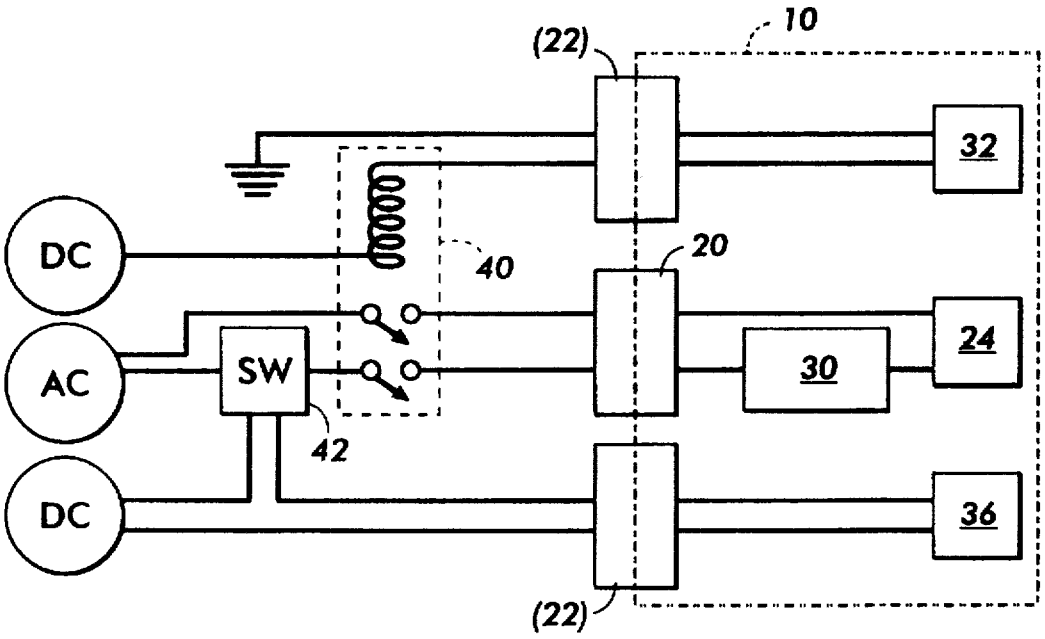
FIG. 2 is a schematic diagram showing the interaction of the elements of the fusing subsystem with the power supplies of a printer or copier.

FIG. 2 is a schematic diagram showing the interaction of the temperature-detecting elements within module 10 with power supplies and other circuit elements which would be found, for example, in a printer or copier. In FIGS. 1 and 2, like numbers indicate like elements, although the connections shown as single wires in FIG. 1 are shown as double wires in FIG. 2. There can thus be seen in FIG. 2, within the box symbolizing module 10, thermal cutoffs 30 and 32, software thermistor 36, and heat lamp 24. Heat lamp 24 and thermal cutoff 30 connect to external power supplies through socket 20, while thermal cutoff 32 and thermistor 36 connect with external circuitry through socket 22 (shown in two parts in FIG. 2 for clarity).

The input to thermal cutoff 32 through socket 22 extends to the "coil side" of a relay generally indicated as 40. One portion of the coil within relay 40 extends to a DC power supply (such as 24 volts) while the other of the two lines extending into thermal cutoff 32 extends, in this example, to ground. When thermal cutoff 32 is conducting electricity, the DC through the coil in relay 40 holds down both lines of the AC supplied through socket 20 to heat lamp 24. If a detected high temperature causes thermal cutoff 32 to break the circuit associated therewith, the coil within relay 40 will no longer hold down the AC lines and the AC supply to heat lamp 24 will be broken. In this way, a high temperature detected on thermal cutoff 32 will result in a breaking of the current to heat lamp 24.

Effectively disposed in series on the AC line that leads ultimately to heat lamp 24 is a software control, symbolized by the block 42 in FIG. 2. Software thermistor 36 changes its resistance in response to a detected temperature and if a DC is supplied to thermistor 36, the changing resistance of thermistor 36 will change the voltage output of thermistor 36. The software 42 monitors the effective voltage signal from thermistor 36, and, if certain conditions are met, cuts off at least one line of the AC power supply that ultimately goes to heating lamp 24. Such a control system as embodied in software 42 can be made sensitive to unique temperature behaviors characteristic of certain types of failure, in particular, to detect unusual increases or decreases in fuser roll temperature within a short period of time, e.g., an increase or drop in temperature of 10 degrees in 10 seconds. If such a condition is detected, the machine can be shut down by the control system of software 42, even though thermal cutoffs 30, 32 have had no reason to break the connection on conductor 26.

There is thus included, in a preferred embodiment of a module 10 of the present invention, three distinct detectors for dangerous temperature conditions within the module 10: the AC thermal cutoff 30, the DC thermal cutoff 32, and the software thermistor 36. Moreover, each individual detector has a distinct role in providing optimal overall safety. AC thermal cutoff 30 is disposed within the paper path, but is spaced somewhat from the surface of fuser roll 10; AC thermal cutoff 30 is thus positioned to detect the situation in which the control software in the machine is not functioning correctly and the contacts of the relay have welded shut. The DC thermal cutoff 32, disposed out of the paper path, but in direct contact with the surface of fuser roll 12, is optimized for detecting problems which may occur when paper has shielded the thermistor and thermal cutoff 30 and/or the software is not operating correctly. The thermal cutoffs 30, 32 and the software responding to the software thermistor 36 can have threshold (i.e., breaking) temperatures which are all the same, or each different, depending on a particular design and expected types of failure.

Also shown in the FIG. 1 embodiment is a chip 50 which is intended to be permanently associated with the module 10, such as by being mounted on an inner surface of housing 16. The purpose of chip 50 is to provide information, within an electronically-readable memory therein, which could be read out by the control system of the printer or copier for operation of the module 10; also, provision could be made through socket 22 or another separate socket to allow the control system of the printer or copier to write information into the electronically-readable memory of chip 50. Among different types of useful information that could be stored in chip 50 include: an identification code to make sure the right type of module 10 is installed in a particular machine; a number indicating the optimal AC voltage or power that should be supplied by the printer or copier to the module 10; a periodically-updated print count indicating how long the particular module 10 has been in use; or, a number relating to maximum rated number of prints permitted to be output by the module before service or remanufacture is required.

Another type of information which could be read into chip 50 through socket 22 by a control system is a record of a specific type of failure detected through thermistor 36 (such as a sudden increase in temperature), along with, for example, the time and date of such a failure condition. If such information is stored within the electronically-readable memory of chip 50, such information can be useful when the module 10 is removed from the printer or copier and subsequently analyzed.

A key practical advantage of the overall design of the module 10 is that the thermal cutoff 30 and the thermal cutoff 32 operate entirely independently of any control software of the printer or copier, as opposed to software thermistor 36 which directly interfaces with the control software 42. This independence of the thermal cutoff 30 and the thermal cutoff 32 from the machine control system is important, because very often a failure in the control software of the machine is either the cause or the result of a failure within the fusing subsystem. Because the control software cannot always be relied upon, it is important to provide safety features which are independent of the control software.

While the invention has been described with reference to the structure disclosed, it is not confined to the details set forth, but is intended to cover such modifications or changes as may come within the scope of the following claims.

We claim:

1. A fuser apparatus for an electrophotographic printer, comprising:

a roll, a portion of a length of the roll defining a width of a paper path;

a heat source;

a conductor for conducting electricity to the heat source;

a first thermal cutoff, for detecting a temperature above a first predetermined threshold within the width of the paper path; and a second thermal cutoff, in direct contact with the roll, for detecting a temperature above a second predetermined threshold not within the width of the paper path.

2. The apparatus of claim 1, the first thermal cutoff being a circuit breaker disposed in series on the conductor.

3. The apparatus of claim 1, the second thermal cutoff being not directly connected to the conductor.

4. The apparatus of claim 1, the first thermal cutoff being operatively disposed more than 1 mm from a surface of the roll.

5. The apparatus of claim 1, further comprising a first socket for connecting the conductor to an external power supply.

6. The apparatus of claim 1, further comprising a socket for connecting the second thermal cutoff to an external power supply.

7. The apparatus of claim 6, further comprising an electronically-readable memory operatively connected to the socket.

8. The apparatus of claim 1, further comprising a software thermistor disposed near the paper path, the software thermistor outputting a signal related to a temperature detected therein.

9. A fuser apparatus for an electrophotographic printer, comprising:

a roll, a portion of a length of the roll defining a width of a paper path;

a heat source;

a conductor for conducting electricity to the heat source;

a first thermal cutoff disposed in series on the conductor and disposed within the width of the paper path, for breaking the conductor in response to detecting a temperature above a first predetermined threshold;

a relay supplying electricity to the conductor;

a second thermal cutoff associated with the relay, the second thermal cutoff being operatively disposed in contact with a surface of the roll not within the width of the paper path, for causing the relay to stop supplying electricity to the conductor in response to detecting a temperature above a second predetermined threshold.

* * * * *